United States Patent [19]

Farrar

[11] Patent Number: 4,833,812

[45] Date of Patent: May 30, 1989

[54] YIELDABLY REINFORCED GUN GRIP

[76] Inventor: Frank W. Farrar, 11941 Paseo Bonita, Los Alamitos, Calif. 90720

[21] Appl. No.: 194,483

[22] Filed: May 16, 1988

[51] Int. Cl.[4] ..... F41C 23/00

[52] U.S. Cl. ..... 42/71.02

[58] Field of Search ..... 42/71.02, 74

[56] References Cited

U.S. PATENT DOCUMENTS

| | | | |
|---|---|---|---|
| 3,672,084 | 6/1972 | Pachmayr | 42/71.02 |
| 3,815,270 | 6/1974 | Pachmayr . | |
| 4,043,066 | 8/1977 | Pachmayr et al. . | |
| 4,132,024 | 1/1979 | Pachmayr et al. | 42/71.02 |
| 4,148,149 | 4/1979 | Pachmayr et al. . | |
| 4,286,401 | 9/1981 | Pachmayr et al. . | |
| 4,359,833 | 11/1982 | Pachmayr et al. | 42/71.02 |
| 4,378,651 | 4/1983 | Pachmayr et al. | 42/71.02 |
| 4,625,445 | 12/1986 | Ruger | 42/71.02 |
| 4,638,582 | 1/1987 | Farrar | 42/71.02 |

*Primary Examiner*—Deborah L. Kyle
*Assistant Examiner*—Richard W. Wendtland
*Attorney, Agent, or Firm*—Beehler, Pavitt, Siegemund, Jagger, Martella & Dawes

[57] ABSTRACT

A semi-resilient pistol grip is made as a one-piece unit with side panels attached to each other at both forward and rear edges by relatively thin resilient portions. Yieldable reinforcement plates are embedded by molding within the side panels. The hollow interior of the grip is specially shaped so as to interlock with the frame of the pistol to retain the grip in place after it has been applied.

13 Claims, 2 Drawing Sheets

YIELDABLY REINFORCED GUN GRIP

The invention here under consideration is one involving a cushioned grip for a gun, particularly a hand gun or pistol, and is an improvement on a comparable grip disclosed in U.S. Pat. No. 4,638,582.

Quite commonly the practice heretofore has been for manufacturers of pistols and hand guns to equip them with shaped grips of hard material in the form of matching side panels, one applied to each appropriate face of the handle, with customarily one or more screws to hold the side panels in place.

The fact that a great many users and owners of hand guns find such hard two-piece grips undesirable has prompted those owners and users to seek replacement grips of various kinds which can be fitted to the conventional handle frame.

Because of the weight of guns and pistols of the character described and the recoil effect on the hand of the user, the more acceptable replacement grips have been those of elastomeric material. To enjoy the advantages of such elastomeric grip material, special features have been resorted to. One of these is to provide a special shape for the exterior of the side panels in order to have them neatly fit into the hand of the user. Another has been to resort to a one-piece structure capable of fitting neatly around the metal handle frame. Still another has been to provide such a grip with a form-fitting expedient so that once attached, it remains firmly in place.

It is therefore among the objects of the invention to provide a new and improved one-piece cushion type grip for the handle frame of a gun which can be applied in one simple operation to the handle frame once the original side panels have been removed.

Another object of the invention is to provide a new and improved single piece grip which is relatively easy to attach to the handle frame and also one which is readily removable for replacement, should that become desirable.

Still another object of the invention is to provide a new and improved snug-fitting handle grip of a cushion-like consistency which fits neatly in the hand of the user when in actual use.

Still another object of the invention is to provide a new and improved one-piece cushion-like grip for a gun handle of such form and design that it flows neatly into the form and pattern of the gun itself.

Also included among the objects of the invention is to provide a new and improved one-piece grip for the handle frame of a hand gun which requires no auxiliary fastening means to hold it in place once it has been applied.

A further object of the invention is to provide a grip for both sides of a handle frame of a pistol or hand gun specially reinforced so that although initially molded to fit snugly around the handle frame, it can nevertheless be stretched to a degree sufficient to enable attachment entirely by hand and of such consistency that even though stretched during the attachment procedure, it will return to its original snug-fitting position and remain so in a firmly attached condition until there may be some occasion for removal.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

In the drawings

Figure 1:
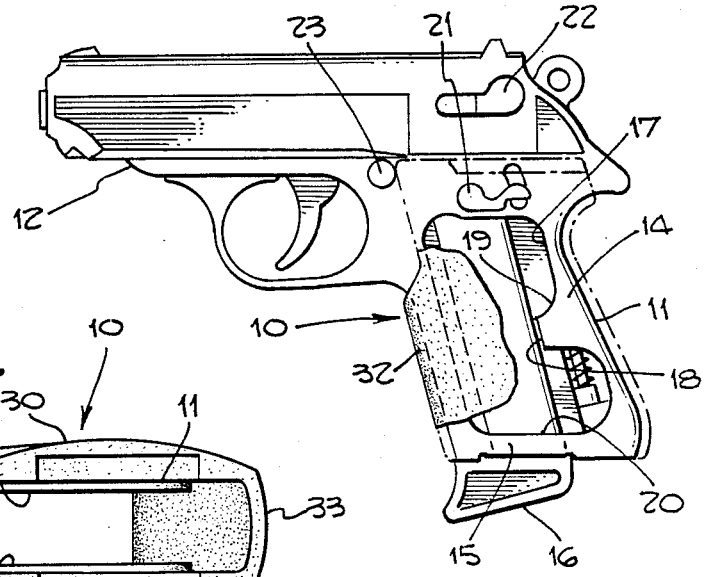
FIG. 1 is a side elevational view of a typical automatic hand gun with a portion of the yieldably reinforced gun grip of the invention applied to the handle frame.

In an embodiment of the invention chosen for the purpose of illustration the grip 10 is shown as one useful for application to a handle frame 11 for a conventional automatic hand gun 12. In a hand gun of the type made reference to the handle frame 11 is made up of a forward frame member 13 connected to an aft frame member 14 at lower ends of each by a bottom frame member 15. In the bottom frame member 15 is the customary opening for reception of a magazine 16. The frame members encompass an open interior 17, housing in part the magazine. A projection 18 extending forwardly of the aft frame member 14 provides a shoulder 19, there being also a shoulder 20 provided by each side of the bottom frame member 15. Also needing to be accommodated by the interior of the grip is a rotating trigger mechanism 21, visible on one side, and a comparable trigger mechanism (not shown) on the opposite side. A safety lever 22 pivots downwardly to a position where it needs to be accommodated on the exterior of the grip. A button 23 is useful in locking and releasing the magazine 16.

Figure 4:
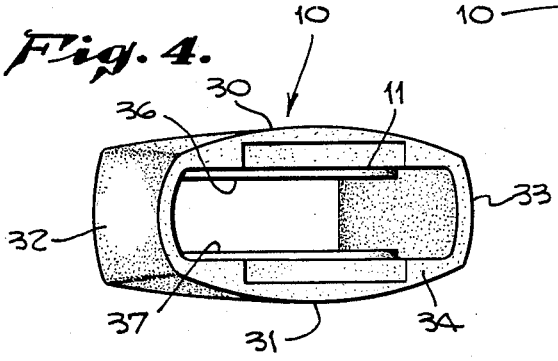
FIG. 4 is a bottom plan view on the line 4—4 of FIG. 2.
Figure 2:
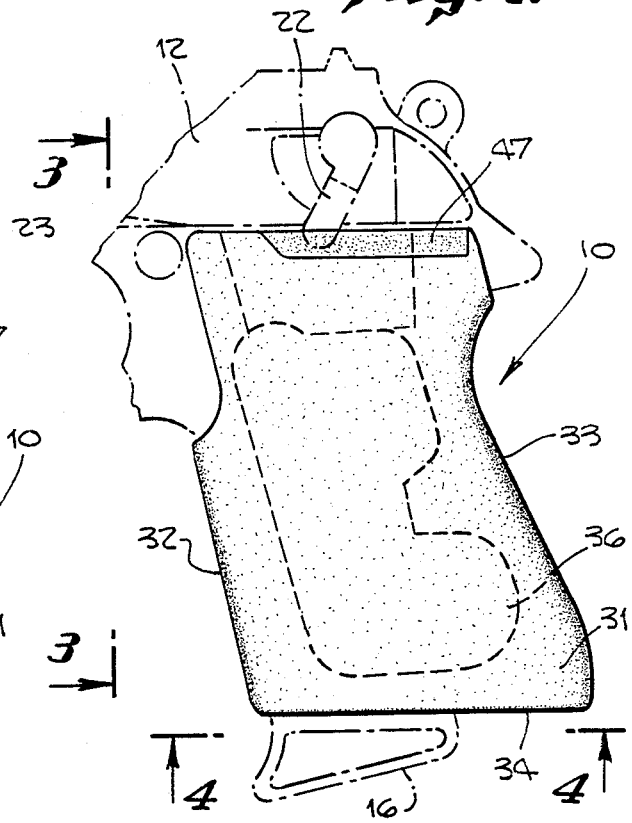
FIG. 2 is a enlarged side elevational view of the handle with the grip attached.
Figure 3:
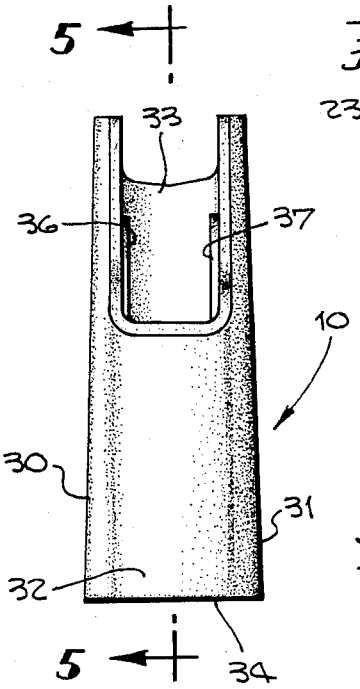
FIG. 3 is a vertical elevational view on the line 3—3 of FIG. 2.

The grip 10 itself, shown separately in FIGS. 3 and 4, preferably of elastomeric material, is a pre-molded single piece structure consisting of side panels 30 and 31 interconnected adjacent the forward frame member 13 by a forward panel 32 and interconnected adjacent the aft frame member 14 by means of a rearward panel 33. A butt portion 34 adjacent the bottom frame member 15 provides a passage 35 through which the magazine 16 may be extended.

Figure 6:
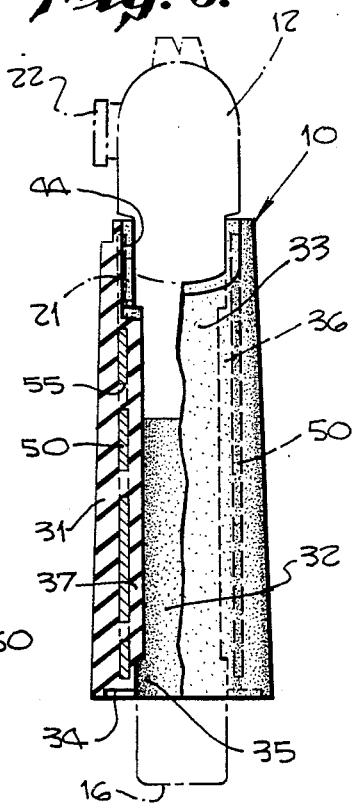
FIG. 6 is a vertical sectional view on the line 6—6 of FIG. 5.
Figure 7:
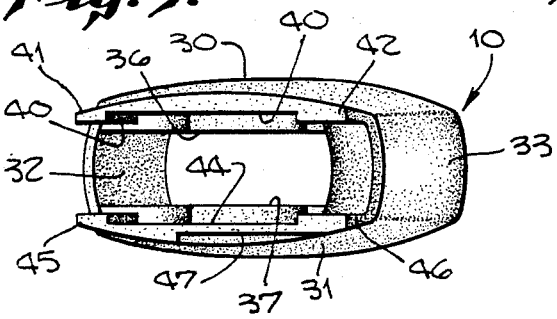
FIG. 7 is a top plan view of the grip taken on the line 7—7 of FIG. 5.

As is apparent in FIG. 6, the rearward panel 33 in initially molded form is adapted to follow the exterior contour of the aft frame member 14. The forward panel 32, shorter in length, follows the slope of the forward frame member 13 to a location adjacent the trigger guard of the gun. The side panel 31 extends upwardly above the top of the rearward panel 33 to a location overlying the lever 21. The side panel 30 on the opposite side extends upwardly to substantially the same level. As a consequence, the entire handle frame 11 is adapted to be completely encased within the elastomeric grip 10.

Side panels 30 and 31 are relatively thick and arcuately formed on the exterior. The forward panel 32 is relatively thinner throughout its length, with vertical edges integral with and connected to corresponding vertical edges of the side panels and, moreover, sufficiently flexible to take the arcuate form of the forward frame member 13. The rearward panel 33 is similarly proportioned, with its vertical edges attached as they are and integral with corresponding vertical edges of the side panels.

On the inner face of the side panel 30 is an inwardly projection portion 36. For the side panel 31 there is a similar inwardly projecting portion 37. The purpose of the inwardly projecting portions is to provide an interlock between the grip and the handle frame when the parts are assembled together to prevent inadvertent dislodgment of the grip from the handle frame. Dislodgment is prevented in part by having the lowermost ends of the inwardly projecting portion 36, for example, overlie the shoulder 20 which is the upper edge of the bottom frame member 15 on a corresponding side of the grip.

At about the mid-section of the inwardly projecting portion 36 there is a cut-back edge 38, a part of which is adapted to overlie the shoulder 19 of the aft frame member 14. In the chosen embodiment the inwardly projecting portion 36 is given substantially the same outline as the inside edges of the frame members so that the portion 36 substantially fills the space defined by those edges. The inwardly projecting portion 37 on the inside face of the corresponding panel 31 is formed in substantially the same fashion so that there is also an overlying relationship with respect to the corresponding edge of the bottom frame member 15 and the corresponding shoulder 19 of the projection 18 on the aft frame member 14.

To make certain that there is no obstruction to operation of the lever portion 21 of the hand gun or its counterpart on the opposite side, there is provided a recess 40 at the upper end of the side panel 30 intermediate fore and aft corners 41, 42. There is a similar recess 44 on the inner face of the side panel 31 intermediate fore and aft corners 45, 46. Additionally, at the upper end of the side panel 31 there is an exterior recess 47 to accommodate the swing of the safety lever 22.

Figure 9:
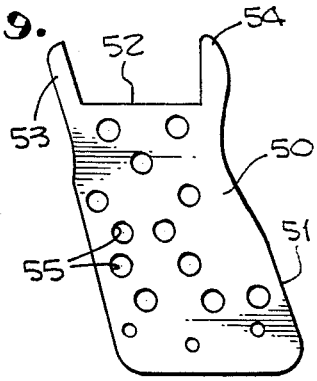
FIG. 9 is a side elevational view of the reinforcement plate.
Figure 8:
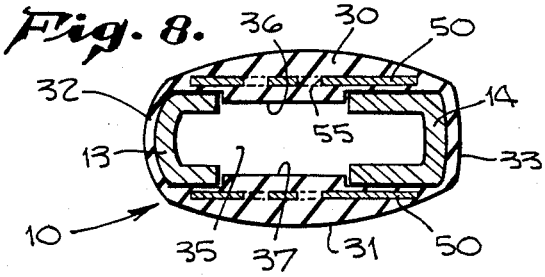
FIG. 8 is a cross-sectional view on the line 8—8 of FIG. 5.

Of special consequence is the presence of and character of a reinforcing plate 50, the form of which is shown in FIG. 9. A perimetrical edge 51 of the reinforcing plate has substantially the outline of the perimetrical edge of the side panel in which it is embedded. There is a reinforcing plate for each of the side panels 30, 31. It is important that the reinforcing plate be substantially rigid but, at the same time, flexible and with a memory, spring steel being an appropriate example. Other material having a comparable characteristic is likewise acceptable.

Figure 5:
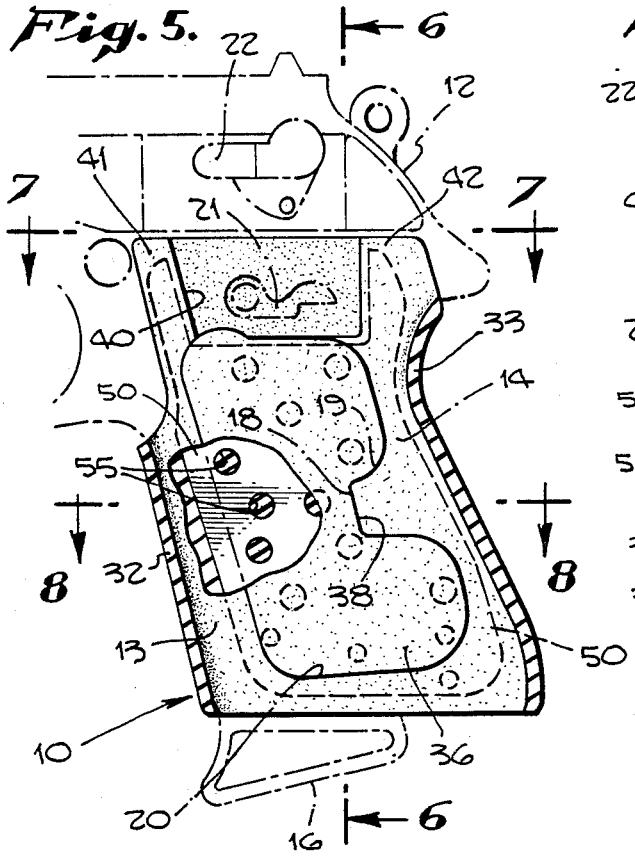
FIG. 5 is a vertical sectional view on the line 5—5 of FIG. 3.

At the upper end of the perimetrical edge 51 the reinforcing plate has a relieved section 52 between fore and aft ends, leaving upwardly extending projections 53, 54. A scattered array of holes 55 is provided in the reinforcing plate within which the elastomeric material of the side panel can extend when the reinforcing plate is embedded by molding in the panel intermediate opposite faces of the panel. The relieved section 52 follows essentially the outline of the recess 40 or 44, as the case may be, which is provided at the upper end of the corresponding side panel. In this way adequate reinforcing of the side panel extends entirely to the top of the panel as well as to the bottom of the panel, irrespective of need for provision of the recesses 40, 44, see FIG. 5.

Figure 10:
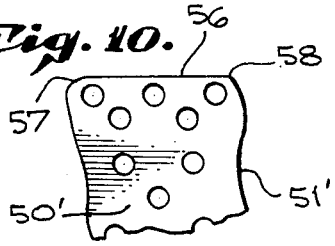
FIG. 10 is a fragmentary side elevational view of a modified form of reinforcement plate.

In the form of invention of FIG. 10 a plate 50' having a perimetrical edge 51' has a top section 56 extending directly between fore and aft corners 57, 58.

When the grip 10 fashioned as described is adapted to be applied to the handle frame 11, because of its elastomeric character. Especially because of the yieldability of the reinforcing plate 50, the side, forward and rearward panels of the grip can be fixed outwardly sufficient so that the inwardly projecting portions 36 and 37 can ride over the bottom frame member 15. When the grip reaches its proper position, the inwardly projecting portions 36, 37 will project into the space within the frame members so that appropriate portions will overlie the shoulders 19, 20 previously made reference to. In this position also the initially flat reinforcing plate, although having been bent outwardly during application of the grip, returns by its inherent spring return characteristic to initial flat position where it is able to foreceably hold the inwardly projecting portions 36, 37 in their positions overlying the shoulders. In this way the characteristic of the reinforcing plate in cooperation with the elastomeric return capability of the grip provides a firm retention of the grip on the handle frame.

Conversely, when there is occasion to remove the grip from the handle frame, the side panels can be pried outwardly against tension exerted by the reinforcing plate until the inwardly projecting portions are cleared from engagement with the shoulders. In this way, relieved of the interlock, the grip can be withdrawn downwardly and outwardly out of engagement with the handle frame. Moreover, due to the resilient characteristics as described, the same grip can be reapplied, if need be, or another grip of comparable characteristics substituted.

Further, by reason of the fact that the uppermost ends of the side panels are reinforced by the upwardly extending projections 53, 54, the grip when applied will hold its position snugly at the top, despite absence of action of the forward and rearward panels which do not extend entirely to the upper end of the grip. Moreover, by employment of an initially flat, although resilient, reinforcing plate, the plate when molded into the elastomeric material of the side panels can be lodged relatively close to the inside faces, in this way leaving a substantial thickness of elastomeric material on the outside. Presence of a stiff reinforcing plate, accordingly, does not impair the cushioning effect of the elastomeric material in the hand of the user when the weapon is being handled.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A yieldably reinforced grip for the handle frame of a hand gun wherein the frame has an open interior between fore and aft frame members, shoulder means projecting into the open interior from said frame members and actuating means adjacent the frame, said grip comprising a single piece pocket-like member of elastomeric material having a pair of opposite side panels, a forward panel and a rear panel, each side panel having a pre-molded shape and size corresponding to the shape and size of the corresponding side face of the frame, a reinforcement plate for each side panel having a molded-in-place location intermediate outer and inner faces of the corresponding panel, said reinforcement plate having an initial planar surface condition adapted in cooperation with the corresponding side panel to hold said corresponding side panel in engagement with the adjacent side of the frame, said reinforcement plate being of a material of yieldable composition capable of deflection under pressure from said planar surface condition and returning to the initial planer surface condition after deflection, the said reinforcement plate being of consistency relatively stiffer than the consistency of the corresponding side panel.

2. A yieldably reinforced grip for the handle frame of a hand gun as in claim 1 wherein said forward and rear panels comprise an interconnection between the side panels and the corresponding reinforcement plates with each other and with the frame at fore and aft edge portions of said side panels.

3. A yieldably reinforced grip for the handle frame of a hand gun as in claim 1 wherein said side panels comprise an elastomeric material having a yieldable consistency less than the material of said frame.

4. A yieldably reinforced grip for the handle frame of a hand gun as in claim 3 wherein each said reinforcement plate has a perimetrical edge extending throughout side and end edge portions of the corresponding panel.

5. A yieldably reinforced grip for the handle frame of a hand gun as in claim 4 wherein said reinforcement plate has openings within said perimetrical edge receptive of molded material of said side panel.

6. A yieldably reinforced grip for the handle frame of a hand gun as in claim 4 wherein said side panel has a recess on the inside face intermediate upper fore and aft corners at a location coincident with the location of said actuating means and there is a recess in the reinforcement plate corresponding in size and shape to the recess in the panel.

7. A yieldably reinforced grip for the handle frame of a hand gun as in claim 4 wherein each said panel has a recess on the inside face intermediate upper fore and aft corners at a location coincident with the location of said actuating means and there is a recess in the corresponding reinforcement plate corresponding in shape and size to the recess in the panel, there being projecting means on the inner face of each of said side panels at a location coincident with the shoulder means on said frame.

8. A yieldably reinforced grip for the handle frame of a hand gun as in claim 4 wherein said reinforcement plate comprises a yieldable resilient metallic member enveloped on all side faces and edges by the material of said panel.

9. A yieldably reinforced grip for the handle frame of a hand gun as in claim 4 wherein said reinforcement plate comprises a non-metallic member enveloped on all side faces and edges by the material of the corresponding panel and wherein said reinforcement plate has a stiffness in excess of the stiffness of said panel.

10. A yieldably reinforced grip for the handle frame of a hand gun as in claim 2 wherein the forward and rear panels each comprise a portion of said elastomeric material of thickness relatively less than the thickness of said side panels and interconnect adjacent vertical edge portions of said side panels.

11. A yieldably reinforced grip for the handle frame of a hand gun as in claim 2 wherein the forward and rear panels each comprise a portion of said elastomeric material of uniform thickness relatively less than the thickness of said side panels and interconnect adjacent vertical edge portions of said side panels adjacent corresponding fore and aft frame members.

12. A yieldably reinforced grip for the handle frame of a hand gun as in claim 1 wherein there is projecting means on the inner face of at least one of said side panels at a location coincident with the shoulder means of said frame.

13. A yieldably reinforced grip for the handle frame of a hand gun as in claim 1 wherein there is a projecting means on the inner face of each of said side panels at a location coincident with the corresponding shoulder means of said frame.

* * * * *